US010317842B2

(12) United States Patent
Nakata et al.

(10) Patent No.: US 10,317,842 B2
(45) Date of Patent: Jun. 11, 2019

(54) TIMEPIECE MAINSPRING, TIMEPIECE DRIVE DEVICE, TIMEPIECE MOVEMENT, TIMEPIECE, AND MANUFACTURING METHOD OF TIMEPIECE MAINSPRING

(71) Applicant: Seiko Epson Corporation, Tokyo (JP)

(72) Inventors: Keisuke Nakata, Matsumoto (JP); Masao Takeuchi, Azumino (JP); Shogo Kobayashi, Shiojiri (JP)

(73) Assignee: Seiko Epson Corporation (JP)

( * ) Notice: Subject to any disclaimer, the term of this patent is extended or adjusted under 35 U.S.C. 154(b) by 61 days.

(21) Appl. No.: 15/486,766

(22) Filed: Apr. 13, 2017

(65) Prior Publication Data

US 2017/0308037 A1 Oct. 26, 2017

(30) Foreign Application Priority Data

Apr. 25, 2016 (JP) ..... 2016-087424
Jan. 20, 2017 (JP) ..... 2017-008650

(51) Int. Cl.
*G04B 1/18* (2006.01)
*G04B 1/16* (2006.01)
*G04B 1/14* (2006.01)

(52) U.S. Cl.
CPC ..... *G04B 1/18* (2013.01); *G04B 1/145* (2013.01); *G04B 1/16* (2013.01)

(58) Field of Classification Search
CPC ..... G04B 1/18; G04B 1/145; G04B 1/16
USPC ..... 368/142, 203, 140
See application file for complete search history.

(56) References Cited

U.S. PATENT DOCUMENTS

2007/0133355 A1* 6/2007 Hara ..... C22C 14/00 368/140
2009/0303842 A1 12/2009 Gritti et al.
2014/0022873 A1* 1/2014 Ching ..... G04B 17/066 368/175

FOREIGN PATENT DOCUMENTS

GB 647819 A 12/1950
JP 63-303627 A 12/1988
JP 63-303628 A 12/1988
JP 2009-300439 A 12/2009

OTHER PUBLICATIONS

W .A. C. Swift, "An Analysis of the Spiral Spring", Ph.D. Thesis, University of Sheffield, 35 pages (Summary through p. 20), Jul. 1971 (retrieved from the internet on Feb. 13, 2018; http://etheses.whiterose.ac.uk/id/eprint/15015).
Extended European Search Report for Patent Application No. EP 17167507.7 dated Feb. 27, 2018 (9 pages).

* cited by examiner

*Primary Examiner* — Edwin A. Leon
(74) *Attorney, Agent, or Firm* — Harness, Dickey & Pierce, P.L.C.

(57) ABSTRACT

A timepiece mainspring is accommodated inside a barrel, an inner end thereof is fixed to a barrel arbor included in the barrel, and an outer end thereof engages with an inner wall of the barrel. The timepiece mainspring includes a helical portion wound in a Bernoulli curve shape from the inner end in a free state having no applied load.

12 Claims, 17 Drawing Sheets

TIMEPIECE MAINSPRING, TIMEPIECE DRIVE DEVICE, TIMEPIECE MOVEMENT, TIMEPIECE, AND MANUFACTURING METHOD OF TIMEPIECE MAINSPRING

BACKGROUND

1. Technical Field

The present invention relates to a timepiece mainspring, a timepiece drive device, a timepiece movement, a timepiece, and a manufacturing method of a timepiece mainspring.

2. Related Art

In a mechanical timepiece, as a power source, a power device is generally used which includes a barrel and a mainspring accommodated inside the barrel (for example, refer to JP-A-2009-300439).

In the mainspring of JP-A-2009-300439, in a free state, an inner end side thereof fixed to a barrel arbor is wound approximately 1.5 times in a helical shape.

In a state where the mainspring as in JP-A-2009-300439 is accommodated inside the barrel, the inner end of the mainspring is fixed to the barrel arbor. The mainspring is wound around the barrel arbor, and an outer end thereof engages with an inner wall of the barrel. When the timepiece is used, winding and unwinding of the mainspring are repeated. Here, compared to other portions, in a helical portion on the inner end side of the mainspring, a displacement amount increases due to the winding and unwinding.

In the mainspring in the related art as in JP-A-2009-300439, the helical portion on the inner end side is generally formed in a shape which is plastically deformed if the mainspring is wound. Therefore, after the mainspring is accommodated inside the barrel and wound, durability is degraded compared to that before the mainspring is wound.

For these reasons, there is a problem in that the helical portion on the inner end side of the mainspring is likely to have fatigue failure.

SUMMARY

An advantage of some aspects of the invention is to provide a timepiece mainspring which is less likely to have fatigue failure, a timepiece drive device, a timepiece movement, a timepiece, and a manufacturing method of a timepiece mainspring.

A timepiece mainspring according to an aspect of the invention is accommodated inside a barrel, an inner end thereof is fixed to a barrel arbor included in the barrel, and an outer end thereof engages with an inner wall of the barrel. The timepiece mainspring includes a helical portion that is wound in a Bernoulli curve shape from the inner end in a free state having no applied load.

Here, for example, the free state having no applied load means a state where the timepiece mainspring is placed on an upper surface on a flat base so that an axial direction of the helical portion is orthogonal to the upper surface.

The helical shape does not mean a three-dimensional curve shape, but means a two-dimensional curve shape which is not displaced in the axial direction of the helical portion.

Before the timepiece mainspring is accommodated in the barrel, the timepiece mainspring is molded in a shape including the helical portion. The molded timepiece mainspring is accommodated in the barrel. The inner end is fixed to the barrel arbor, and the outer end engages with the inner wall of the barrel.

According to the aspect of the invention, since plastic deformation caused by winding can be restrained in the helical portion, durability can be improved. In this manner, it is possible to restrain the timepiece mainspring from having fatigue failure.

A timepiece mainspring according to another aspect of the invention includes an inner end that is accommodated inside a barrel, and that is fixed to a barrel arbor included in the barrel, a winding portion that is continuous with the inner end, and that is wound around the barrel arbor, a helical portion that is continuous with the winding portion, and an outer end that engages with an inner wall of the barrel. In a free state having no applied load, the helical portion is wound in a Bernoulli curve shape.

The winding portion is wound around the barrel arbor even in a state where the timepiece mainspring is unwound. Accordingly, the winding portion is not displaced due to winding and unwinding of the timepiece mainspring.

Therefore, even if the winding portion does not have the Bernoulli curve shape, the timepiece mainspring is less likely to have the fatigue failure. Therefore, the winding portion has a curved shape according to an outer periphery of the barrel arbor so as to be wound around the barrel arbor in a free state, for example.

In a free state, the helical portion is wound in the Bernoulli curve shape. Accordingly, durability can be improved. In this manner, it is possible to restrain the timepiece mainspring from having fatigue failure.

In the timepiece mainspring according to the aspect of the invention, it is preferable that the number of rolls of the helical portion is 2.5 times or more.

As the number of rolls of the helical portion increases, the durability is improved.

Since the number of rolls of the helical portion is set to 2.5 rolls or more, it is possible to satisfy a general level of the durability (for example, the number of winding times: 700 times).

In the timepiece mainspring according to the aspect of the invention, it is preferable that a material of the timepiece mainspring is a nickel cobalt alloy.

According to the aspect of the invention with this configuration, for example, compared to a case where a material of the timepiece mainspring is stainless steel, it is possible to improve durability, a torque, and corrosion resistance of the timepiece mainspring.

In the timepiece mainspring according to the aspect of the invention, it is preferable that a material of the timepiece mainspring is stainless steel.

According to the aspect of the invention with this configuration, for example, compared to a case where a material of the timepiece mainspring is a nickel cobalt alloy, it is possible to reduce material cost.

A timepiece drive device according to still another aspect of the invention includes the timepiece mainspring described above and the barrel that accommodates the timepiece mainspring.

The timepiece mainspring is likely to be broken compared to the barrel. Accordingly, a component service life of the timepiece drive device can be lengthened by providing the timepiece mainspring which is less likely to be broken.

A timepiece movement according to still another aspect of the invention includes the timepiece drive device described above and a gear that is driven by the timepiece drive device.

According to the aspect of the invention, it is possible to restrain the timepiece mainspring from having fatigue failure. Therefore, it is possible to lengthen a component replacement period of the timepiece movement.

A timepiece according to still another aspect of the invention includes the timepiece movement described above.

According to the aspect of the invention, it is possible to restrain the timepiece mainspring from having fatigue failure. Therefore, it is possible to lengthen a component replacement period of the timepiece.

Still another aspect of the invention is directed to a manufacturing method of a timepiece mainspring which is accommodated inside a barrel, whose inner end is fixed to a barrel arbor included in the barrel, and whose outer end engages with an inner wall of the barrel. The method includes deforming a mainspring member, and forming a helical portion wounded in a Bernoulli curve shape from one end, in the mainspring member.

According to the aspect of the invention, it is possible to improve durability of the helical portion, and it is possible to restrain the timepiece mainspring from having fatigue failure.

In the manufacturing method of a timepiece mainspring according to the aspect of the invention, it is preferable that the mainspring member is curved by causing the mainspring member to project to and come into contact with a tilting surface, and that the helical portion is formed by adjusting a projection speed of the mainspring member and a distance between a projection position of the mainspring member and the tilting surface.

According to the aspect of the invention with this configuration, for example, compared to a case where the helical portion is formed by winding the mainspring member around a rod-shaped jig, it is possible to easily form the helical portion in a short time.

Still another aspect of the invention is directed to a manufacturing method of a timepiece mainspring which is accommodated inside a barrel, whose inner end is fixed to a barrel arbor included in the barrel, whose outer end engages with an inner wall of the barrel, and which includes a helical portion wound in a Bernoulli curve shape from the inner end in a free state having no applied load. The Bernoulli curve is a curve satisfying a relationship of $R=ae^{b\theta}$ in a case where in polar coordinates, a length of a straight line drawn from an original point to a point on the curve is set to R, an angle formed between the straight line and a starting line is set to θ, an angle formed between the straight line and a tangent line of the point on the curve is set to b, a value of R when θ is zero degrees is set to a, and the number of Napier is set to e. In a case where $e^b$ is set to a constant A, a lower limit value of the constant A is determined based on an effective number of rolls of the timepiece mainspring and an upper limit value of the constant A is determined based on durability and a torque of the timepiece mainspring. The constant A is set to a value in a range from the lower limit value to the upper limit value, and a mainspring member is deformed so as to form the helical portion in the mainspring member.

An effective number of rolls of the timepiece mainspring which determines revolving speed of the barrel until the timepiece mainspring inside the barrel is unwound after being wound decreases as a value of a constant A is smaller. Accordingly, there is a case where a standard value of the effective number of rolls may not be satisfied. Therefore, according to the aspect of the invention, a lower limit value of the constant A is determined based on the effective number of rolls. Durability of the timepiece mainspring decreases as the value of the constant A is greater. Therefore, if the constant value A reaches a certain value or greater, it is not possible to obtain a state where both the durability and the torque satisfy the standard value. Therefore, according to the aspect of the invention, an upper limit value of the constant A is determined based on the durability and the torque. The constant A is set to be in a range from the lower limit value to the upper limit value, thereby forming the helical portion.

According to this configuration, it is possible to reliably manufacture the timepiece mainspring in which the effective number of rolls, the durability, and the torque satisfy the standard value.

Still another aspect of the invention is directed to a manufacturing method of a timepiece mainspring which includes an inner end that is accommodated inside a barrel, and that is fixed to a barrel arbor included in the barrel, a winding portion that is continuous with the inner end, and that is wound around the barrel arbor, a helical portion that is continuous with the winding portion, and an outer end that engages with an inner wall of the barrel. The helical portion is wound in Bernoulli curve shape in a free state having no applied load. The Bernoulli curve is a curve satisfying a relationship of $R=ae^{b\theta}$ in a case where in polar coordinates, a length of a straight line drawn from an original point to a point on the curve is set to R, an angle formed between the straight line and a starting line is set to θ, an angle formed between the straight line and a tangent line of the point on the curve is set to b, a value of R when θ is zero degrees is set to a, and the number of Napier is set to e. In a case where $e^b$ is set to a constant A, a lower limit value of the constant A is determined based on an effective number of rolls of the timepiece mainspring and an upper limit value of the constant A is determined based on durability and a torque of the timepiece mainspring. The constant A is set to a value in a range from the lower limit value to the upper limit value, and a mainspring member is deformed so as to form the helical portion in the mainspring member.

According to the aspect of the invention, it is possible to reliably manufacture the timepiece mainspring in which the effective number of rolls, the durability, and the torque satisfy the standard value.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment according to the invention will be described with reference to the drawings.

Figure 1:
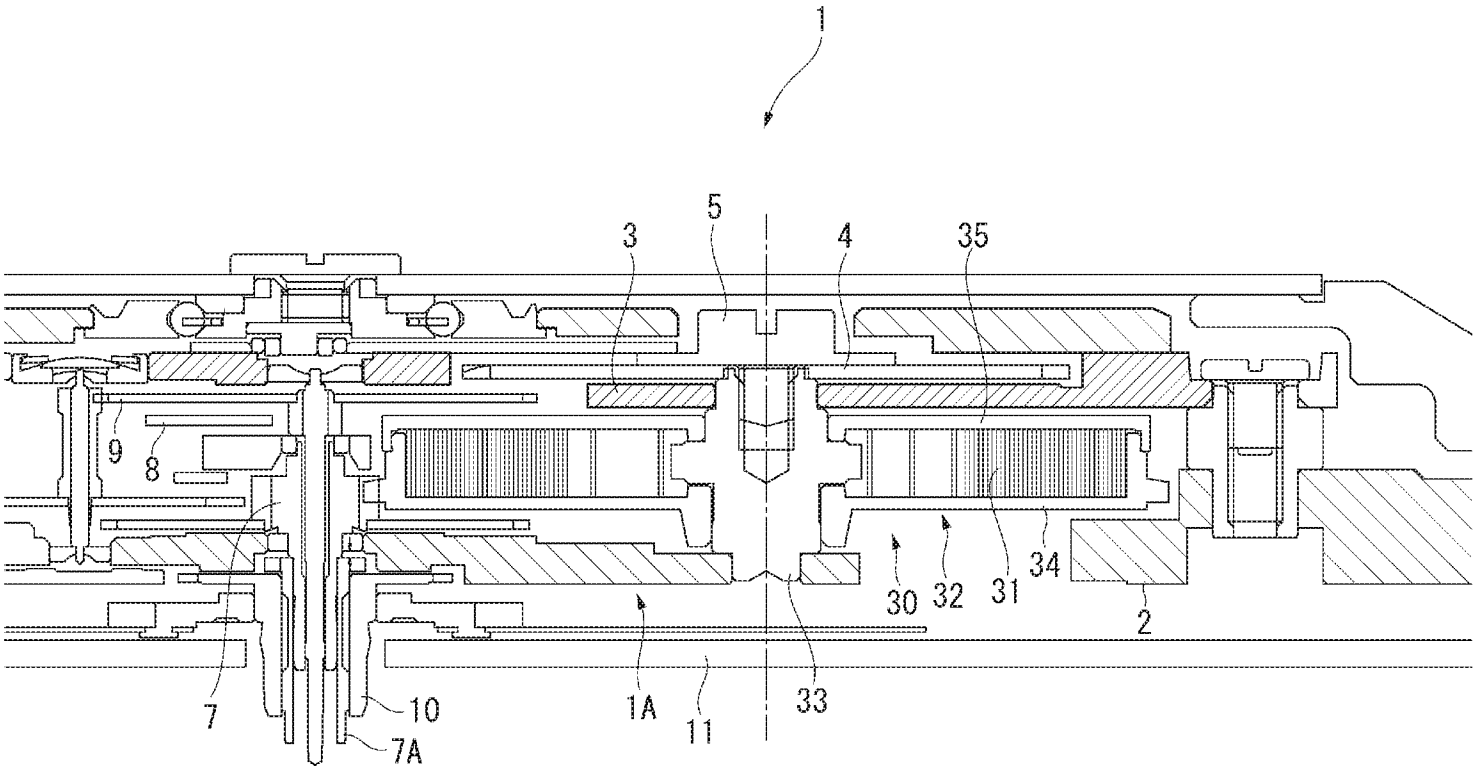
FIG. 1 is a sectional view illustrating a timepiece according to an embodiment of the invention.

FIG. 1 is a sectional view illustrating a timepiece 1.

The timepiece 1 includes a drive mechanism (timepiece movement) 1A on a rear cover side of a dial 11. The drive mechanism 1A includes a power device (timepiece drive device) 30 configured to include a mainspring (timepiece mainspring) 31 and a barrel 32 which accommodates the mainspring 31.

The barrel 32 includes a barrel arbor 33, a barrel wheel 34 and a barrel cover 35 which are attached to the barrel arbor 33.

In the mainspring 31, an inner end 311 (refer to FIG. 3) is fixed to the barrel arbor 33. The mainspring 31 is wound around the barrel arbor 33. An outer end 312 thereof (refer to FIG. 2) engages with an inner wall 341 (refer to FIG. 2) of the barrel wheel 34.

The barrel arbor 33 is supported by a main plate 2 and a train wheel bridge 3, and is fixed by a ratchet screw 5 so as to rotate integrally with a ratchet wheel 4 included in the drive mechanism LA. The ratchet wheel 4 meshes with a click (illustration omitted) so as to rotate in a clockwise direction and so as not to rotate in a counterclockwise direction.

A method of winding the mainspring 31 by rotating the ratchet wheel 4 in the clockwise direction is the same as a method of an automatic or hand-winding mechanism of a general mechanical timepiece. Thus, description thereof will be omitted.

The rotation of the barrel wheel 34 is transmitted to gears such as a center wheel & pinion 7, a third wheel & pinion 8, a second wheel & pinion 9, and an hour wheel 10 which are included in the drive mechanism LA. A second hand (not illustrated) is attached to the second wheel & pinion 9, and a minute hand (not illustrated) is attached to a cannon pinion 7A of the center wheel & pinion 7. An hour hand (not illustrated) is attached to the hour wheel 10. In this manner, the barrel wheel 34 is rotated, thereby driving each indicating hand.

Configuration of Power Device

Figure 2:
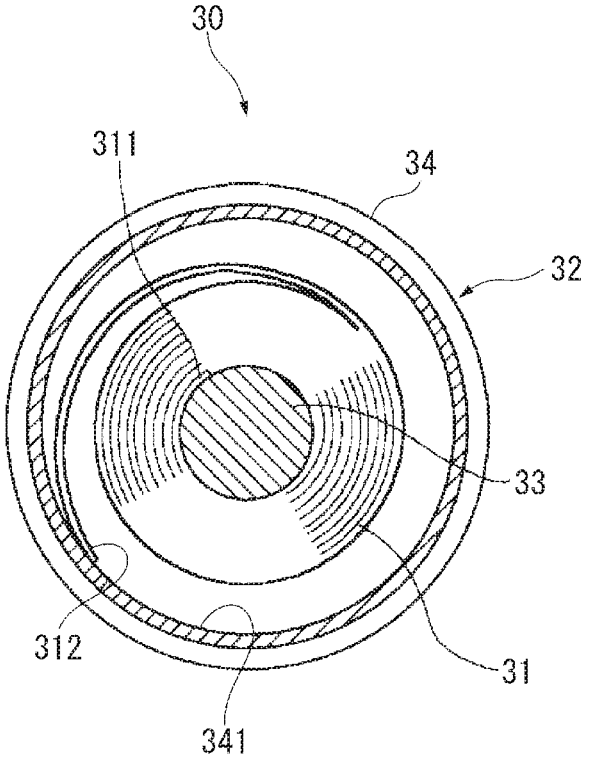
FIG. 2 is a plan view illustrating a power device in a state where a mainspring according to the embodiment is wound.
Figure 3:
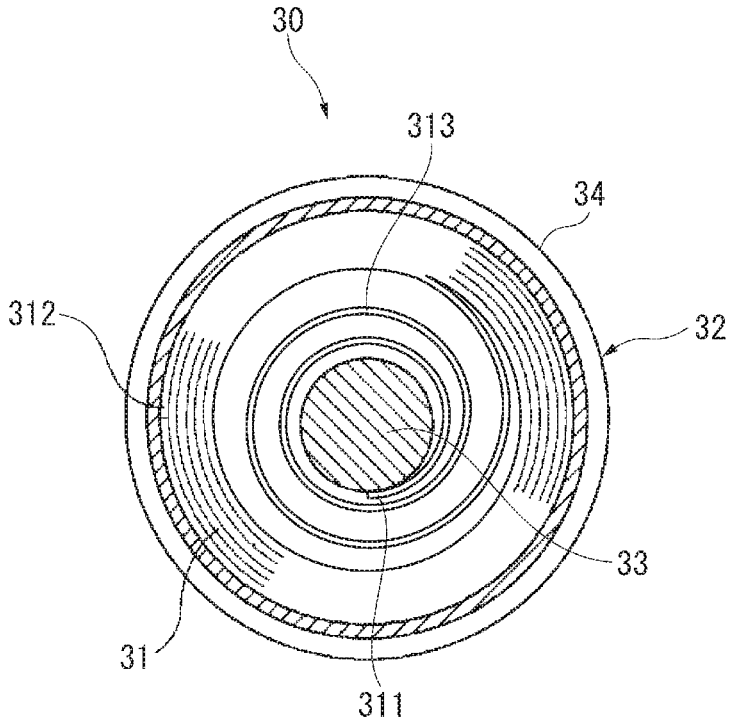
FIG. 3 is a plan view illustrating the power device in a state where the mainspring according to the embodiment is unwound.

FIGS. 2 and 3 are plan views when the power device 30 is viewed in a thickness direction. FIGS. 2 and 3 omit the illustration of the barrel cover 35.

FIG. 2 illustrates a state after the mainspring 31 is wound inside the barrel 32, and FIG. 3 illustrates a state after the mainspring 31 is unwound inside the barrel 32 (released state).

The inner end 311 of the mainspring 31 is fixed to the barrel arbor 33. According to the present embodiment, an outer diameter of the barrel arbor 33 is 2.6 mm. Here, the mainspring 31 is fixed to the barrel arbor 33 so that a width direction extends along the axial direction of the barrel arbor 33.

The outer end 312 of the mainspring 31 engages with the inner wall 341 by being caught on a notch formed on the inner wall 341 of the barrel wheel 34 or by being caught on the inner wall 341 via a slipping attachment (not illustrated). According to the embodiment, an inner diameter (diameter of an accommodation space of the mainspring 31) of the barrel wheel 34 is 10.6 mm.

As illustrated in FIG. 2, the barrel arbor 33 is rotated by an external force, thereby winding the mainspring 31 around the barrel arbor 33.

If a restrained state of the barrel wheel 34 is released, the barrel wheel 34 is rotated around the barrel arbor 33 as an axis, and the mainspring 31 is unwound as illustrated in FIG. 3.

In a released state illustrated in FIG. 3, a portion having a predetermined length from the inner end 311 extends in a helical shape in a plan view, thereby configuring a helical portion 313. The number of rolls of the helical portion 313 is set to 2.5 rolls to 3.0 rolls in the embodiment.

A portion located on the outer end 312 side from the helical portion 313 in the mainspring 31 is wound in a substantially concentric circle shape formed around the barrel arbor 33 in the plan view.

In the helical portion 313, a displacement amount caused by the winding and unwinding is larger than that of other portions, and stress is greatly changed.

Configuration of Mainspring

Figure 4:
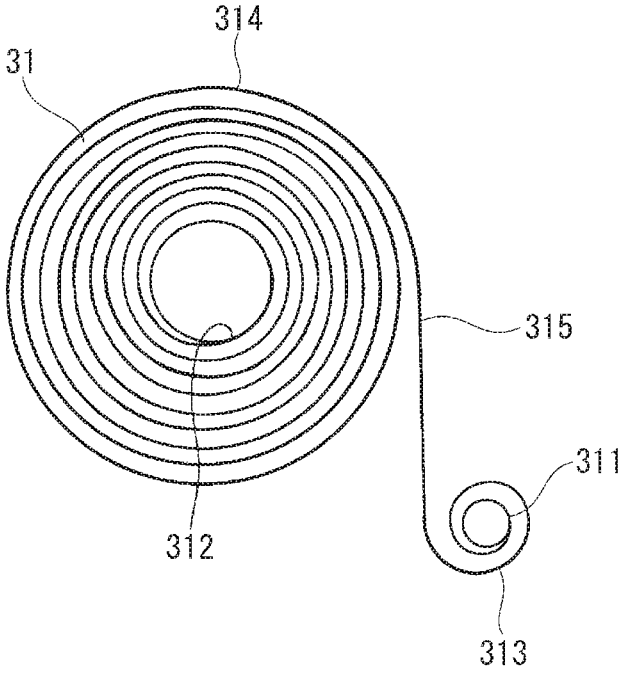
FIG. 4 is a view illustrating the mainspring in a free state according to the embodiment.

FIG. 4 is a view illustrating the mainspring 31 in a free state having no applied load before the mainspring 31 is accommodated in the barrel 32. That is, FIG. 4 is a view illustrating the mainspring 31 in a free state before the mainspring 31 is wound. Here, for example, the free state having no applied load means a state in a case where the timepiece mainspring is placed on an upper surface of a flat base so that the axial direction of the helical portion is orthogonal to the upper surface.

The mainspring 31 includes the helical portion 313, a connection portion 315 which is not shaped to be continuous from the helical portion 313, and a mainspring body portion 314 which is continuous from the connection portion 315 and which is wound approximately 10 times in a direction opposite to a winding direction of the helical portion 313. The helical shape does not mean a three-dimensional curve shape, but means a two-dimensional curve shape which is not displaced in the axial direction of the helical portion.

Here, the helical portion 313 is wound in a Bernoulli curve shape from the inner end 311. Here, although an example will be described in detail later, according to the embodiment, it is preferable that the number of rolls of the helical portion 313 is 2.5 rolls or more in order to ensure required durability. In order to ensure required duration (for example, 46.5 hours), it is preferable that the number of rolls is 3.0 rolls or smaller.

Figure 5:
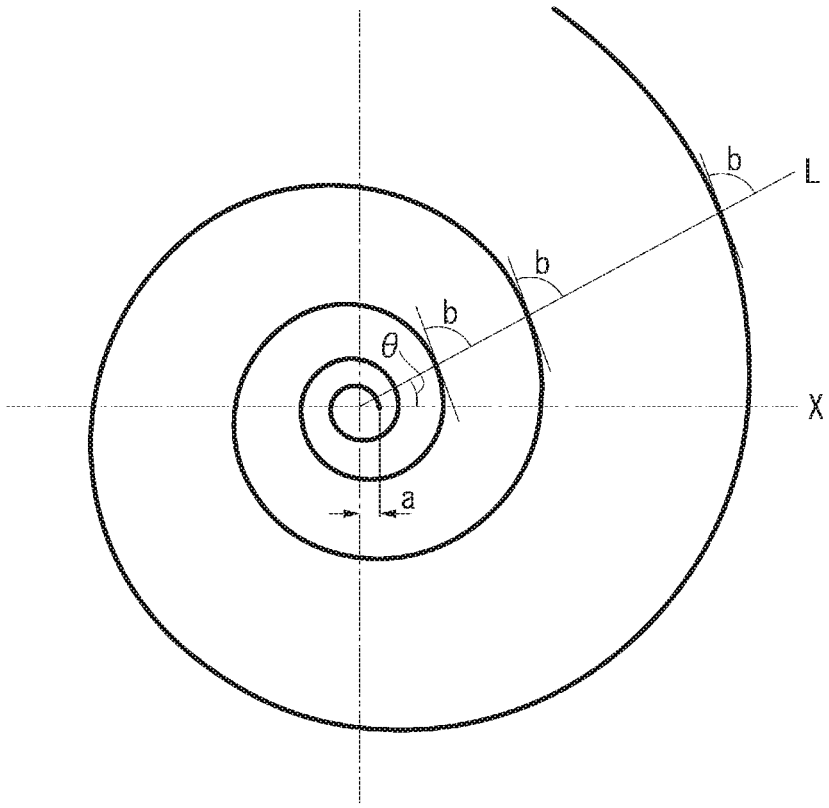
FIG. 5 is a view for describing a Bernoulli curve.

As illustrated in FIG. 5, the Bernoulli curve is a curve (helix) expressed by Equation (1) below, in a case where in polar coordinates, a length of a straight line L drawn from an original point to a point on the curve (distance from the original point) is set to R, an angle (argument angle) formed between the straight line L and a starting line X is set to $\theta$, an angle formed between the straight line L and a tangent line of the point on the curve is set to b, a value of R when θ is zero degrees is set to a, and the number of Napier is set to e.

$$R=ae^{b\theta} \quad (1)$$

That is, in a case where $e^b$ is set to a constant A, the Bernoulli curve is expressed by Equation (2) below.

$$R=aA^{\theta} \quad (2)$$

In the embodiment, the mainspring 31 is configured to include a nickel cobalt alloy. The mainspring 31 may be configured to include the other metal such as stainless steel.

The mainspring 31 is formed to have a constant width and a constant thickness over the entire length of the mainspring 31. The width dimension (dimension in the axial direction of the barrel arbor 33) is approximately 1 mm, and the thickness dimension is approximately 0.1 mm. The length dimension of the mainspring 31 is approximately 300 mm.

Manufacturing Method of Mainspring

Next, a manufacturing method of the mainspring 31 will be described. The mainspring 31 is produced through heat treatment after a shape machining process for forming a shape illustrated in FIG. 4 is performed on a plate-shaped mainspring member 31M.

Shape Machining Device

Figure 6:
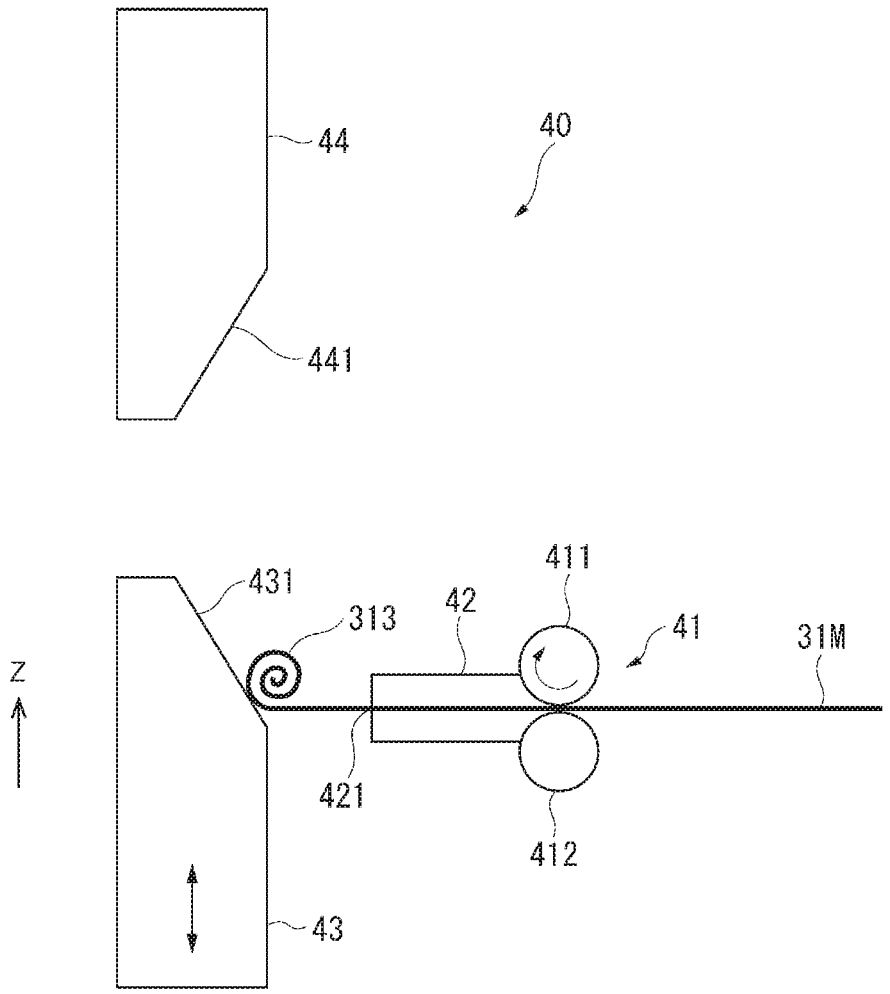
FIG. 6 is a view illustrating a shape machining process according to the embodiment.

In the shape machining process, a shape machining device 40 illustrated in FIG. 6 is used.

The shape machining device 40 includes an extrusion unit 41 that includes extrusion rollers 411 and 412 for extruding the mainspring member 31M, a guide unit 42 that guides the extruded mainspring member 31M in a predetermined direction so as to project therefrom, and shape forming units 43 and 44 that performs shape forming (customization) by deforming the projected mainspring member 31M.

The extrusion unit 41 is configured to be capable of adjusting extrusion speed (projection speed) of the mainspring member 31M by adjusting rotation speed of the extrusion rollers 411 and 412.

The guide unit 42 causes the mainspring member 31M to project from a projection unit 421 in the predetermined direction.

The shape forming unit 43 is configured to be movable in a Z-direction orthogonal to the projection direction of the mainspring member 31M, and in a direction opposite to the Z-direction.

The shape forming unit 43 includes a tilting surface 431 with which the mainspring member 31M projected from the projection unit 421 comes into contact. As the shape forming unit 43 moves in the Z-direction, the tilting surface 431 tilts in a direction away from the projection unit 421.

The shape forming unit 44 is configured to be movable in the Z-direction, and in the direction opposite to the Z-direction.

The shape forming unit 44 includes a tilting surface 441 with which the mainspring member 31M projected from the projection unit 421 comes into contact. As the shape forming unit 44 moves in the direction opposite to the Z-direction, the tilting surface 441 tilts in the direction away from the projection unit 421.

Shape Machining Process

As illustrated in FIG. 6, in a shape machining process, the shape forming unit 43 is first disposed at a position where the mainspring member 31M projected from the projection unit 421 comes into contact with the tilting surface 431. At this time, the shape forming unit 44 is disposed at a position where the projected mainspring member 31M does not come into contact with the tilting surface 441.

In this state, the extrusion unit 41 extrudes the mainspring member 31M. In this manner, the mainspring member 31M projected from the projection unit 421 comes into contact with the tilting surface 431. In this manner, the mainspring member 31M is curved from one end side.

At this time, the extrusion unit 41 extrudes the mainspring member 31M while adjusting extrusion speed in accordance with a preset program. The shape forming unit 43 moves in the Z-direction or in the direction opposite to the Z-direction in accordance with the preset program, thereby bending the mainspring member 31M while adjusting a distance in the projection direction between the projection unit 421 (projection position) and the tilting surface 431.

In this way, the extrusion speed of the mainspring member 31M, and the distance between the projection unit 421 and the tilting surface 431 are adjusted, thereby enabling the mainspring member 31M to be molded in a predetermined helical shape. According to the embodiment, the extrusion speed and the distance are adjusted, thereby forming the helical portion 313 having the Bernoulli curve shape.

Figure 7:
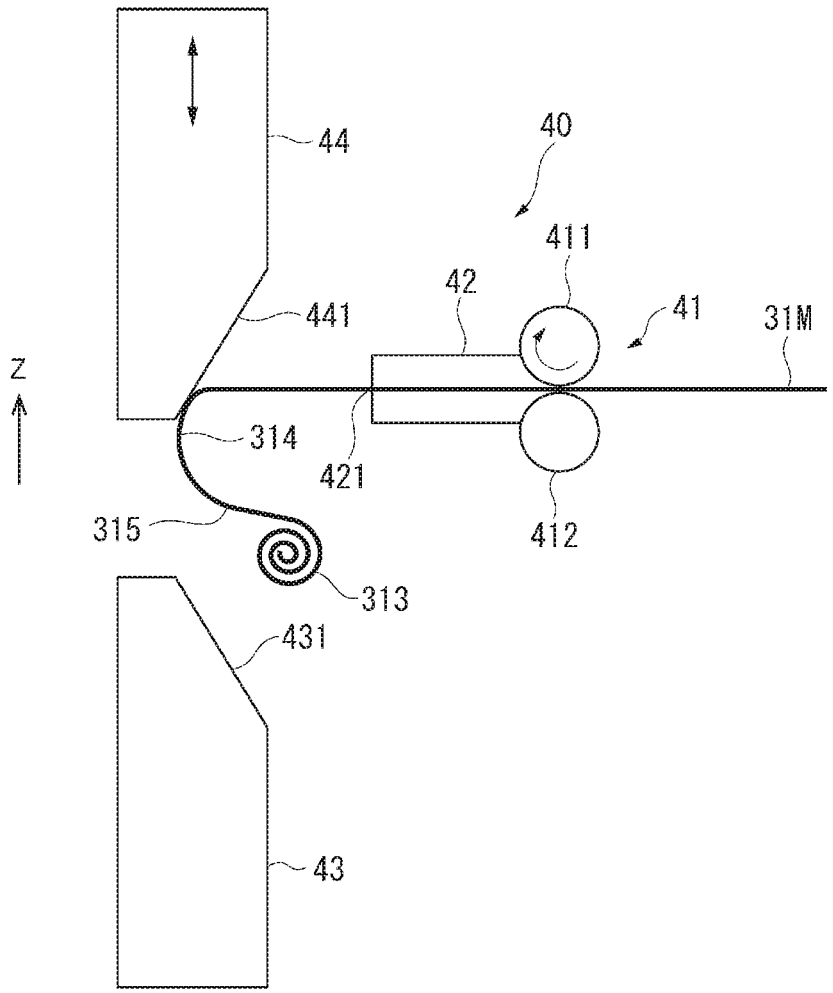
FIG. 7 is a view illustrating the shape machining process according to the embodiment.

After the helical portion 313 is formed, as illustrated in FIG. 7, the shape forming unit 43 moves in the direction opposite to the Z-direction, and awaits at the position where the mainspring member 31M projected from the projection unit 421 does not come into contact with the tilting surface 431.

The shape forming unit 44 moves in the direction opposite to the Z-direction, and awaits at the position where the mainspring member 31M projected from the projection unit 421 comes into contact with the tilting surface 441.

In this state, the extrusion unit 41 extrudes the mainspring member 31M. In this manner, the mainspring member 31M projected from the projection unit 421 comes into contact with the tilting surface 441. In this manner, the mainspring member 31M is curved in a direction opposite to the helical portion 313.

At this time, the extrusion unit 41 extrudes the mainspring member 31M while adjusting the extrusion speed in accordance with the preset program. The shape forming unit 44 moves in the Z-direction or in the direction opposite to the Z-direction in accordance with the preset program, thereby bending the mainspring member 31M while adjusting the distance in the projection direction between the projection unit 421 and the tilting surface 441.

According to the embodiment, the extrusion speed and the distance are adjusted, thereby forming the mainspring body portion 314 which is wound in a direction opposite to the connection portion 315 and the helical portion 313. After the mainspring body portion 314 is formed, the mainspring member 31M is cut. Thereafter, the mainspring member 31M is subjected to heat treatment at approximately 350 degrees. In this manner, the mainspring 31 is produced.

Setting Method of Constant A of Bernoulli Curve

Next, a setting method of the constant A used for the expression of the Bernoulli curve which determines a shape of the helical portion 313 will be described.

Figure 8:
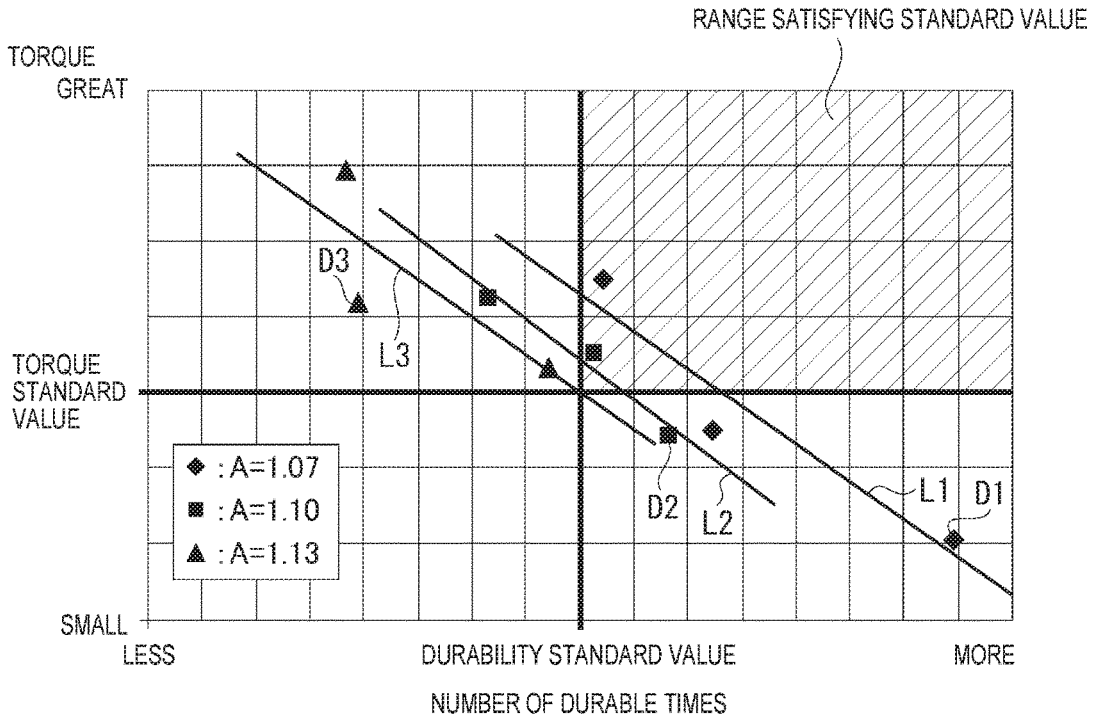
FIG. 8 is a graph illustrating durability and a torque of the mainspring according to the embodiment.

FIG. 8 is a graph illustrating characteristics of durability and a torque of the mainspring 31 in accordance with a value of the constant A.

A horizontal axis of the graph indicates the durability. The durability is indicated by the number of winding times (number of durable times) until the mainspring 31 is broken in a case where the mainspring 31 is repeatedly wound and unwound. A vertical axis of the graph indicates the torque. The torque is obtained after 24 hours elapse from when the mainspring 31 is wound.

A point D1 in the graph illustrates characteristics of three types of the mainspring 31 which are manufactured at first, second, and third heat treatment temperatures by setting the constant A to 1.07. A line L1 indicates a linear function obtained by linearly approximating the point D1. A point D2 illustrates characteristics of three types of the mainspring 31 which are manufactured at the first to third heat treatment temperatures by setting the constant A to 1.10. A line L2 indicates a linear function obtained by linearly approximating the point D2. A point D3 illustrates characteristics of three types of the mainspring 31 which are manufactured at the first to third heat treatment temperatures by setting the constant A to 1.13. A line L3 indicates a linear function obtained by linearly approximating the point D3.

As illustrated in FIG. 8, the durability decreases as the value of the constant A is greater. Therefore, if the constant A reaches a certain value or greater, it is not possible to obtain a state where both the durability and the torque satisfy a standard value. Therefore, in the embodiment, an upper limit value of the constant A is set based on the durability and the torque.

In an example of FIG. 8, in a case where the constant A is smaller than 1.13, depending on the heat treatment temperature, it is possible to obtain the state where both the durability and the torque satisfy the standard value. However, in a case where the constant A is 1.13, it is not possible to obtain the state where both the durability and the torque satisfy the standard value. Therefore, for example, the upper limit value of the constant A is set to 1.12.

Figure 9:
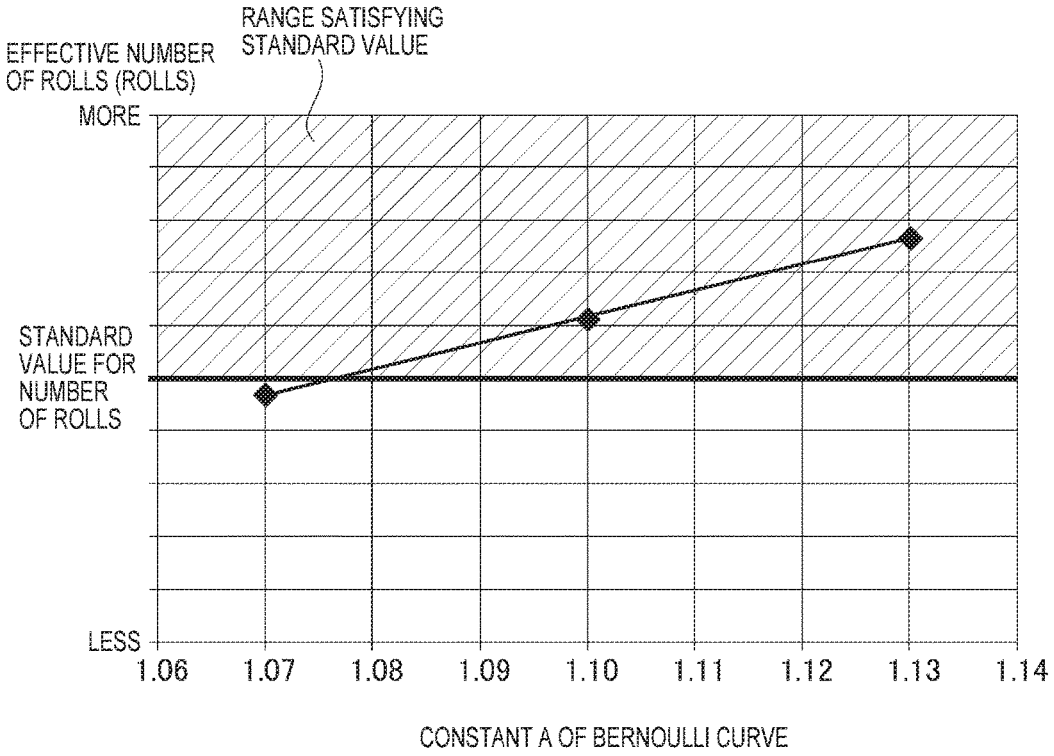
FIG. 9 is a graph illustrating a relationship between a constant A of the Bernoulli curve and an effective number of rolls of the mainspring according to the embodiment.

FIG. 9 is a graph illustrating a relationship between the constant A and an effective number of rolls of the mainspring 31 which determines revolving speed of the barrel 32 until the mainspring 31 inside the barrel 32 is unwound after being wound.

The horizontal axis in the graph indicates the value of the constant A. The vertical axis in the graph indicates the effective number of rolls.

As illustrated in FIG. 9, the effective number of rolls decreases as the value of the constant A is smaller. Accordingly, there is a case where a standard value may not be satisfied. Therefore, according to the embodiment, a lower limit value of the constant A is determined based on the effective number of rolls of the mainspring 31.

In an example of FIG. 9, the effective number of rolls is below the standard value in a case where the constant A is 1.07, and exceeds the standard value in a case where the constant A is 1.08. Accordingly, for example, the lower limit value of the constant A is set to 1.08.

The constant A is set to a value from the lower limit value to the upper limit value, thereby forming the helical portion 313. In this manner, it is possible to reliably manufacture the mainspring 31 in which the effective number of rolls, the durability, and the torque satisfy the standard value.

Operation Effect of Embodiment

The mainspring 31 includes the helical portion 313 which is wound in the Bernoulli curve shape from the inner end 311. Accordingly, it is possible to restrain plastic deformation caused by the winding, and thus, it is possible to improve durability. That is, it is possible to sufficiently minimize stress generated during the winding so as to be smaller than an elastic limit. In this manner, it is possible to restrain the mainspring 31 from having fatigue failure.

A material of the mainspring 31 is the nickel cobalt alloy. Accordingly, for example, compared to a case where the material of the mainspring 31 is stainless steel, it is possible to improve the durability, the torque, and the corrosion resistance of the mainspring 31. In the case where the material of the mainspring 31 is the stainless steel, compared to the case where the nickel cobalt alloy is used, it is possible to reduce the material cost.

The mainspring 31 is likely to be broken compared to the barrel 32. Accordingly, a component service life of the power device 30 can be lengthened by providing the mainspring 31 which is less likely to be broken.

It is possible to restrain the mainspring 31 from having the fatigue failure. Therefore, it is possible to lengthen each component replacement period of the drive mechanism 1A and the timepiece 1.

According to this configuration, for example, compared to a case where the durability is ensured by increasing the thickness dimension of the mainspring 31, it is possible to decrease the thickness dimension of the mainspring 31. Accordingly, the number of rolls of the mainspring body portion 314 can be increased, and duration can be lengthened. In this manner, it is possible to reduce a change between an initial torque generated by the mainspring 31 and a torque generated after 24 hours. Therefore, it is possible to improve isochronism.

For example, compared to a case where the durability is ensured by improving the toughness of the mainspring 31, it is possible to strengthen the hardness of the mainspring 31. Accordingly, it is possible to improve the torque generated by the mainspring 31. In this manner, an oscillation angle of a balance with hairspring (not illustrated) included in the timepiece 1 can be increased to approximately 300 degrees, for example.

In the shape machining process, the extrusion speed of the mainspring member 31M and the distance between the projection unit 421 and the tilting surface 431 are adjusted. In this manner, it is possible to form the helical portion 313. Therefore, for example, compared to a case where the helical portion 313 is formed by winding the mainspring member 31M around a rod-shaped jig, it is possible to easily form the helical portion 313 in a short time.

OTHER EMBODIMENTS

Without being limited to the configurations according to the embodiment, the invention can be modified in various ways within the scope of gist of the invention.

In the embodiment, the number of rolls of the helical portion 313 is set to 2.5 rolls or more. However, the invention is not limited thereto.

As the number of rolls of the helical portion 313 increases, the durability of the mainspring 31 is improved. Therefore, the number of rolls of the helical portion 313 may be smaller than 2.5 rolls as long as the number of rolls of the helical portion 313 is set to the minimum number of rolls or more which can ensure the required durability.

In the embodiment, the number of rolls of the helical portion 313 is set to 3 rolls or smaller. However, the invention is not limited thereto.

As the number of rolls of the helical portion 313 increases, the number of rolls of the mainspring body portion 314 decreases, thereby shortening the duration. The duration is changed depending on the outer diameter of the barrel arbor 33, the inner diameter of the barrel wheel 34, and the thickness dimension, the width dimension, and the length dimension of the mainspring 31.

Therefore, the number of rolls of the helical portion 313 may be set to the number of rolls which can ensure the required duration in accordance with the outer diameter of the barrel arbor 33, the inner diameter of the barrel wheel 34, and the thickness dimension, the width dimension, and the length dimension of the mainspring 31. The number of rolls of the helical portion 313 may be set to be more than 3 rolls such as 3.5 rolls and 4 rolls.

In the embodiment, the width dimension of the mainspring 31 is set to approximately 1 mm, the thickness dimension is set to approximately 0.1 mm, and the length dimension is set to approximately 300 mm. However, the invention is not limited thereto. These dimensions may be appropriately set in accordance with the thickness, the duration, and the required torque of the barrel 32.

However, in order to improve the durability and the duration, it is preferable that the width dimension of the mainspring 31 is set to a range from 0.8 mm to 2.0 mm and the thickness dimension is set to a range from 0.06 mm to 0.20 mm.

In the embodiment, the mainspring 31 is produced through shape machining performed by the shape machining device 40. However, the invention is not limited thereto.

For example, the mainspring 31 may be produced by winding the mainspring member 31M around a helical jig formed in the Bernoulli curve shape.

In the embodiment, the mainspring 31 is wound in the Bernoulli curve shape from the inner end 311, but the invention is not limited thereto.

For example, according to a configuration in which a portion having a predetermined length, which is continuous from the inner end 311 of the mainspring, is wound around the barrel arbor 33, that is, a configuration in which the portion is wound around the barrel arbor 33 by using an elastic force even in a state where the mainspring is unwound, the portion (winding portion) is not displaced due to the winding and the unwinding of the mainspring. Therefore, even if the winding portion does not have the Bernoulli curve shape, the mainspring is less likely to have fatigue failure.

Therefore, in this case, in a free state having no applied load, the winding portion is caused to have a curved shape according to the outer periphery of the barrel arbor 33 so that the winding portion is wound around the barrel arbor 33.

The helical portion continuous with the winding portion is caused to have a shape wound in the Bernoulli curve shape. In this manner, it is possible to improve the durability of the helical portion, and it is possible to restrain the mainspring from having the fatigue failure.

Figure 10:
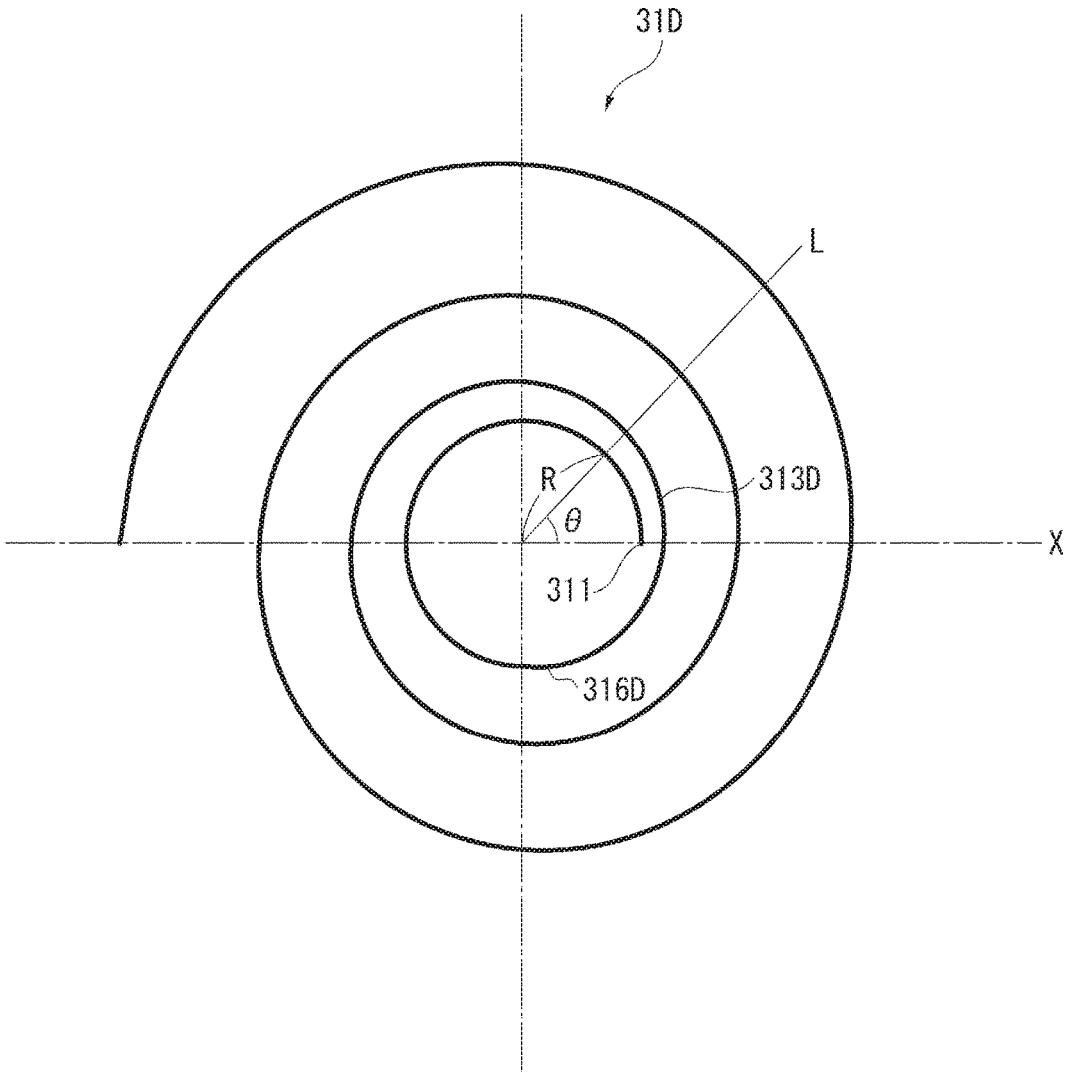
FIG. 10 is a view illustrating a mainspring in a free state according to another embodiment of the invention.

FIG. 10 illustrates a mainspring 31D in a case where a portion of 1.0 roll (rotation angle: 360 degrees) from the inner end 311 is wound around the barrel arbor 33.

As illustrated in FIG. 10, in a free state, the mainspring 31D includes a winding portion 316D which is continuous with the inner end 311 and which is curved according to the outer periphery of the barrel arbor 33, and a helical portion 313D which is continuous with the winding portion 316D and which is wound in the Bernoulli curve shape.

Although the illustration is omitted, the barrel arbor 33 having the mainspring 31D attached thereto has a substantially circular shape in a plan view in the axial direction. In the plan view, from a position where the inner end 311 of the mainspring 31D is fixed to a position where the mainspring 31D is rotated by 270 degrees in the winding direction of the mainspring 31D, a distance from the axial center to the outer periphery of the barrel arbor 33 is constant. From the position where the mainspring 31D is rotated by 270 degrees to a position where the mainspring 31D is rotated by 360 degrees from the position where the inner end 311 is fixed, the distance from the axial center to the outer periphery is gradually lengthened. Therefore, as illustrated in FIG. 10, in the winding portion 316D of the mainspring 31D, a value of R is constant in a portion where a rotation angle θ is in a range from zero degrees to 270 degrees. A portion where the rotation angle θ is in a range from 270 degrees to 360 degrees has a curve shape in which the value of R gradually increases. Here, the value of R is set to a shorter value than the distance from the axial center to the corresponding outer periphery of the barrel arbor 33. In this manner, the winding portion 316D is wound around the barrel arbor 33 by using the elastic force. According to this configuration, for example, a hole is disposed in the inner end 311 of the mainspring 31D, and a protruding portion disposed in the barrel arbor 33 is inserted into the hole. Accordingly, in a configuration in which the inner end 311 is fixed to the barrel arbor 33, the protruding portion is less likely to slip out from the hole. Therefore, the inner end 311 can be reliably fixed to the barrel arbor 33.

The length of the winding portion 316D is not limited to 1.0 roll from the inner end 311. That is, the length of the winding portion 316D is appropriately set in accordance with the length of the mainspring 31D wound around the barrel arbor 33. Similarly to the helical portion 313 of the mainspring 31 according to the embodiment, it is preferable that the helical portion 313D is set to a range from 2.5 rolls to 3.0 rolls. The winding portion 316D and the helical portion 313D are formed by performing the shape machining process the same as that of the mainspring 31.

EXAMPLES

Hereinafter, characteristics of the mainspring 31 will be described in detail with reference to examples and a comparative example. Table 1 illustrates each shape of a mainspring according to each example and the comparative example.

TABLE 1

| | Number of Rolls of Helical Portion | Shape of Helical Portion |
|---|---|---|
| Comparative Example | 2.0 rolls | No Bernoulli Curve |
| Example 1 | 2.5 rolls | Bernoulli Curve |
| Example 2 | 3.0 rolls | Bernoulli Curve |
| Example 3 | 3.5 rolls | Bernoulli Curve |

Comparative Example

Figure 11:
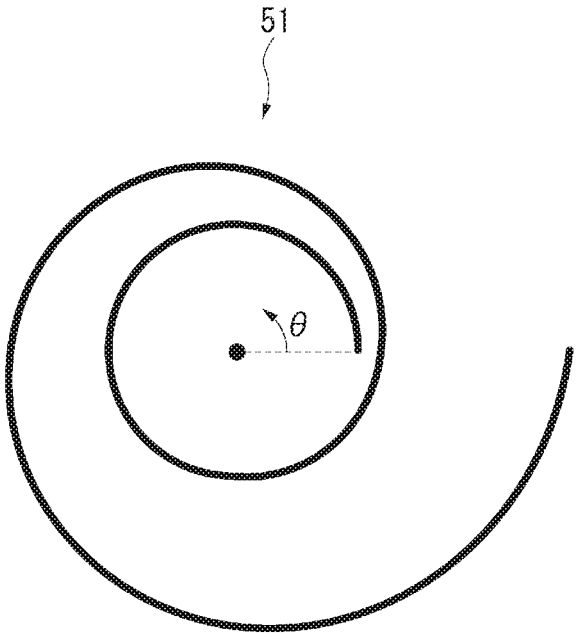
FIG. 11 is a view illustrating a mainspring according to a comparative example.

FIG. 11 is a view illustrating a helical portion of a mainspring 51 according to the comparative example.

(1) Configuration of Mainspring

Made of nickel cobalt alloy as a material; the width dimension being approximately 1 mm; the thickness dimension being approximately 0.1 mm; the length dimension being approximately 300 mm (2) Number of Rolls of Helical Portion: 2.0 rolls (rotation angle θ: 720 degrees)

(3) Shape of Helical Portion: no Bernoulli curve

Example 1

Figure 12:
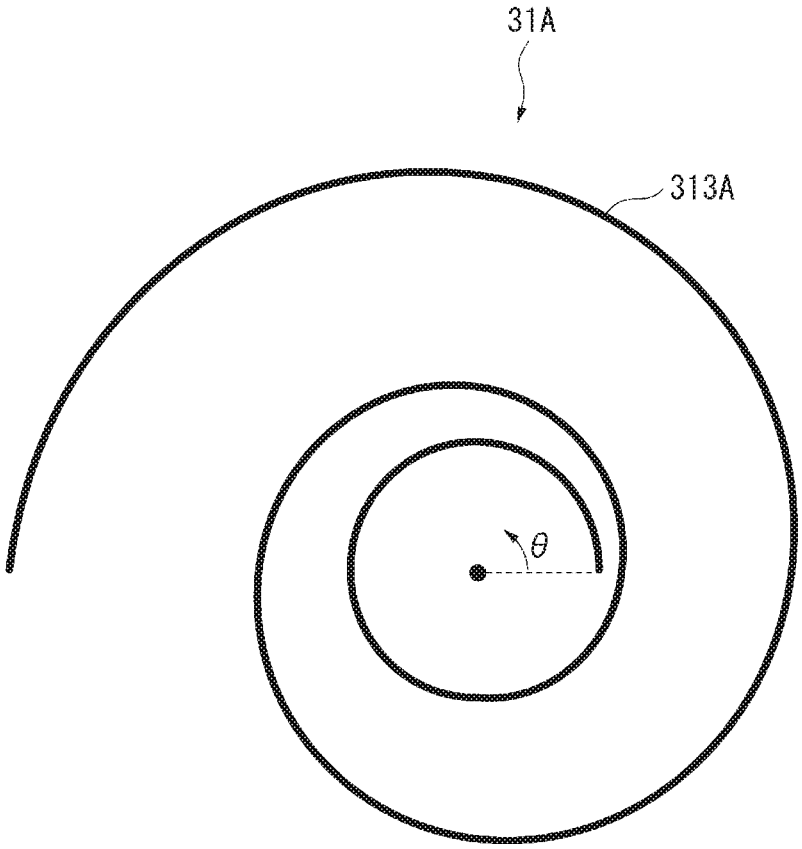
FIG. 12 is a view illustrating a mainspring according to Example 1.

FIG. 12 is a view illustrating a helical portion 313A of a mainspring 31A according to Example 1.

(1) Configuration of Mainspring

The same as that of the comparative example (2) Number of Rolls of Helical Portion: 2.5 rolls (rotation angle θ: 900 degrees)

(3) Shape of Helical Portion: Bernoulli curve

Example 2

Figure 13:
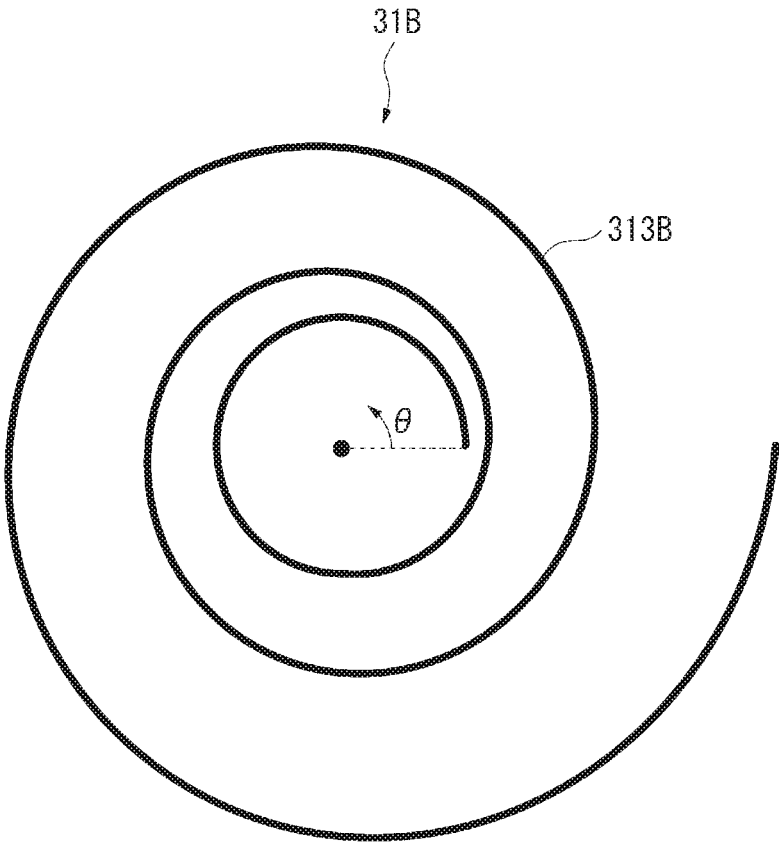
FIG. 13 is a view illustrating a mainspring according to Example 2.

FIG. 13 is a view illustrating a helical portion 313B of a mainspring 31B according to Example 2.

(1) Configuration of Mainspring

The same as that of the comparative example (2) Number of Rolls of Helical Portion: 3.0 rolls (rotation angle θ: 1,080 degrees)

(3) Shape of Helical Portion: Bernoulli curve

Example 3

Figure 14:
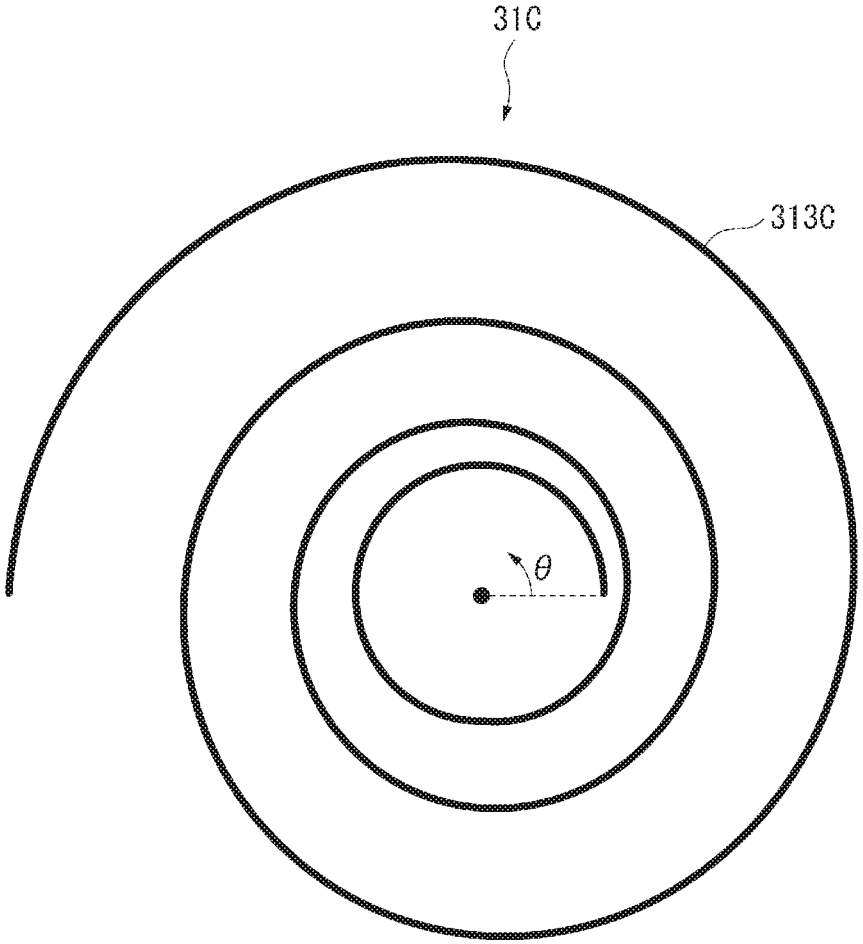
FIG. 14 is a view illustrating a mainspring according to Example 3.

FIG. 14 is a view illustrating a helical portion 313C of a mainspring 31C according to Example 3.

(1) Configuration of Mainspring

The same as that of the comparative example (2) Number of Rolls of Helical Portion: 3.5 rolls (rotation angle θ: 1,260 degrees)

(3) Shape of Helical Portion: Bernoulli curve

Evaluation Method

The durability, the torque, and the duration of the mainspring are evaluated based on the followings. Table 2 illustrates each evaluation result.

Durability

A: above the level

B: the same as the level

C: below the level

Torque

A: above the level

B: the same as the level

C: below the level

Duration

A: above the level

B: the same as the level

C: below the level

TABLE 2

| | Durability | Torque | Duration |
|---|---|---|---|
| Comparative Example | C | A | A |
| Example 1 | B | A | A |
| Example 2 | A | A | B |
| Example 3 | A | A | C |

Evaluation Result of Durability

Figure 15:
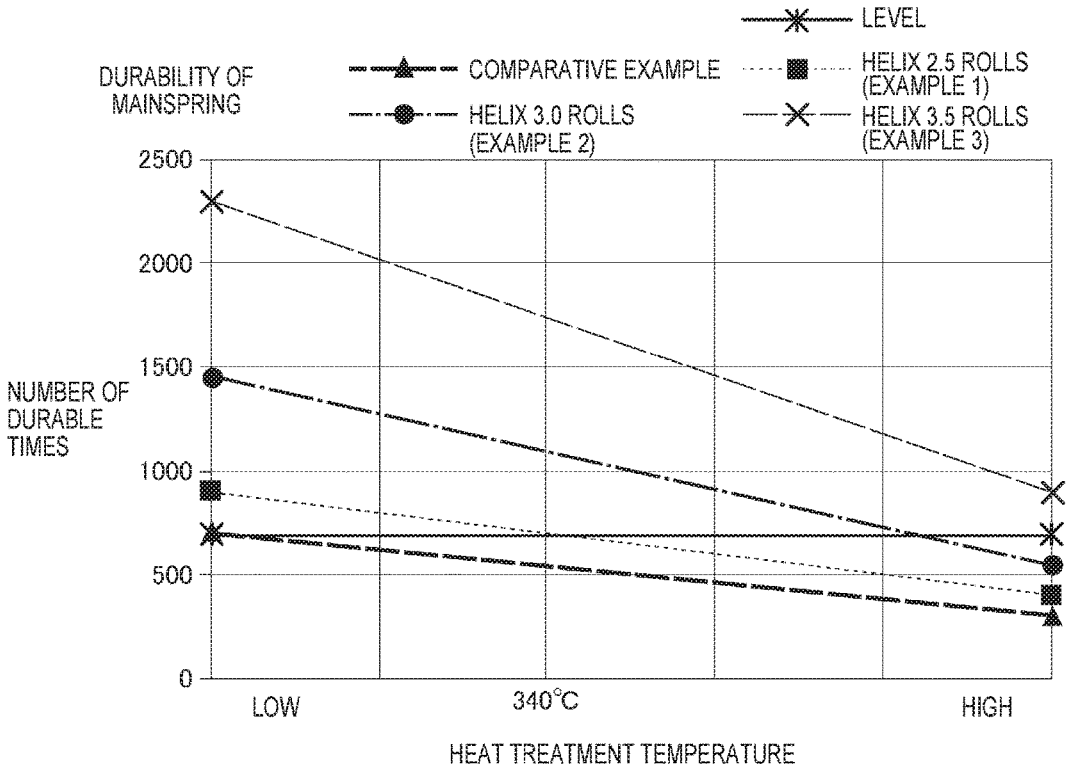
FIG. 15 is a graph illustrating an evaluation result of durability according to each example and the comparative example.

FIG. 15 is a graph illustrating the durability of the mainspring in accordance with a heat treatment temperature.

The durability is illustrated by the number of winding times (number of durable times).

In a case where the heat treatment temperature is approximately 300° C. to 400° C., as the heat treatment temperature is higher, the hardness of the mainspring is improved. On the other hand, the toughness is degraded. Accordingly, the number of durable times tends to decrease.

In general, it is required that the number of durable times is approximately 700 times or more when the heat treatment temperature is approximately 340° C.

According to the comparative example, the number of durable times is approximately 500 times. The comparative example does not satisfy the above-described level.

According to Example 1, the number of durable times is 700 times equal to the minimum level.

According to Example 2, the number of durable times is 1,100 times. Example 2 is significantly beyond the above-described level.

According to Example 3, the number of durable times is 1,700 times. Example 3 is significantly beyond the above-described level.

Based on these results, it is understood that the level of the durability is satisfied if the number of rolls of the helical portion 313 formed in the Bernoulli curve shape is 2.5 rolls or more.

Evaluation Result of Torque

Figure 16:
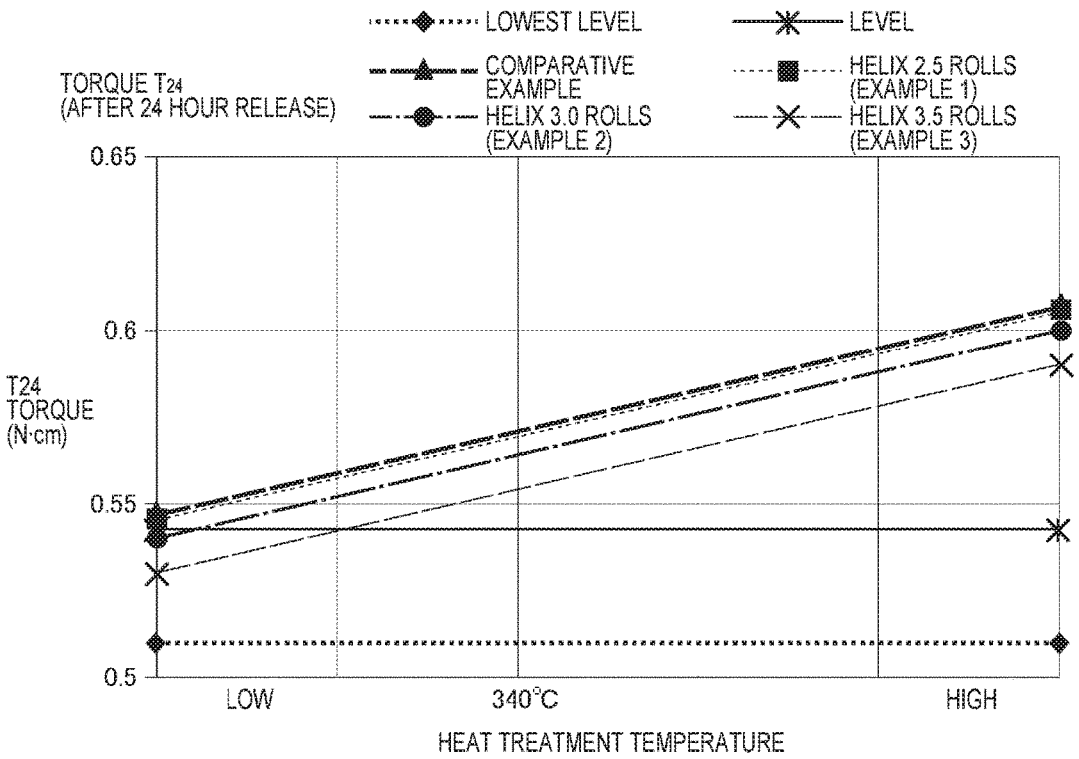
FIG. 16 is a graph illustrating an evaluation result of a torque according to each example and the comparative example.

FIG. 16 is a graph illustrating a torque generated by the mainspring according to the heat treatment temperature.

The torque is obtained after 24 hours elapse from when the mainspring is wound.

As described above, in the case where the heat treatment temperature is approximately 300° C. to 400° C., as the heat treatment temperature is higher, the hardness of the mainspring is improved. Therefore, the torque tends to be improved.

In general, in a case where the heat treatment temperature is approximately 340° C., it is required that the minimum torque is approximately 0.51 N·cm or greater, preferably, approximately 0.54 N·cm or greater.

According to the comparative example, the torque is approximately 0.57 N·cm. The comparative example is beyond the above-described level.

According to Example 1, the torque is approximately 0.57 N·cm. Example 1 is beyond the above-described level.

According to Example 2, the torque is approximately 0.56 N·cm. Example 2 is beyond the above-described level.

According to Example 3, the torque is approximately 0.55 N·cm. Example 3 is beyond the above-described level.

Based on these results, it is understood that as the number of rolls increases, the torque tends to increase. It is understood that the level of the torque is satisfied if the number of rolls of the helical portion 313 formed in the Bernoulli curve shape is 2.5 rolls or more as described above.

Evaluation of Duration

Figure 17:
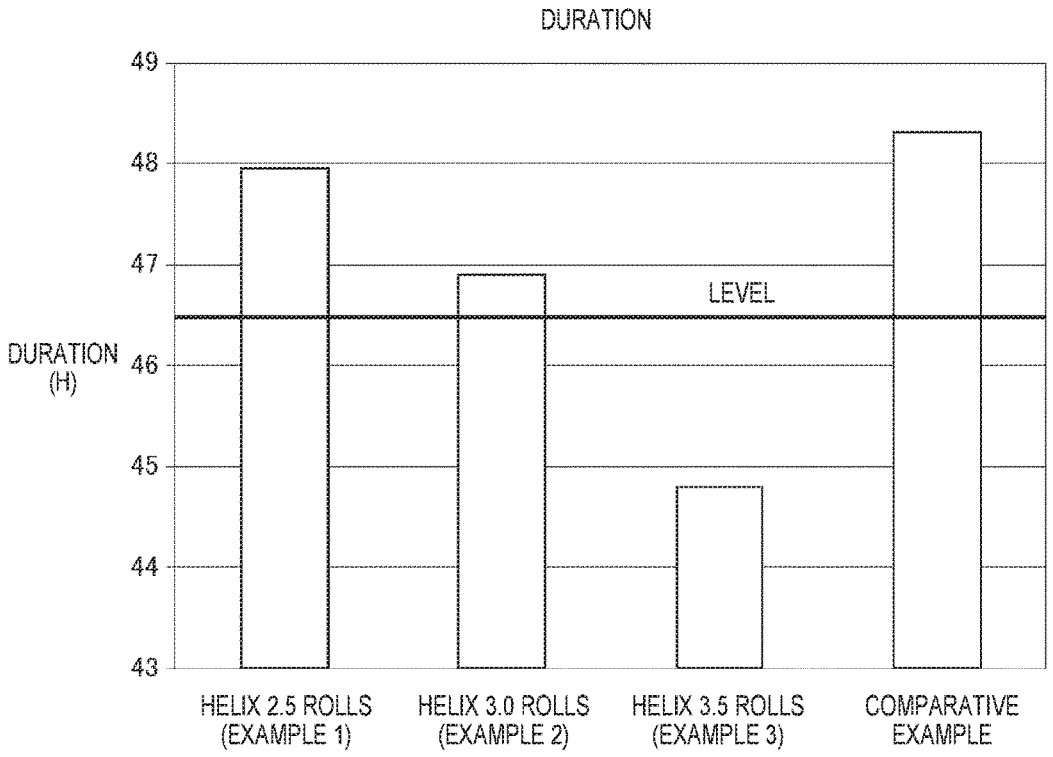
FIG. 17 is a graph illustrating an evaluation result of duration according to each example and the comparative example.

FIG. 17 is a graph illustrating the duration.

In general, it is required that the duration is 46.5 hours or more.

According to the comparative example, the duration is approximately 48 hours. The comparative example is beyond the above-described level.

According to Example 1, the duration is approximately 48 hours. Example 1 is beyond the above-described level.

According to Example 2, the duration is approximately 47 hours. Example 2 is beyond the above-described level.

According to Example 3, the duration is approximately 45 hours. Example 3 is below the above-described level.

Based on these results, it is understood that as the number of rolls increases, the duration tends to be shortened. The reason is as follows. As the number of rolls increases, the length of the helical portion is lengthened. Correspondingly, the length of mainspring body portion is shortened, and the number of rolls decreases.

That is, it is understood that the level of duration is satisfied if the number of rolls of the helical portion 313 formed in the Bernoulli curve shape is 3 rolls or smaller.

The entire disclosures of Japanese Patent Application Nos. 2016-087424, filed Apr. 25, 2016 and 2017-008650, filed Jan. 20, 2017 are expressly incorporated by reference herein.

What is claimed is:

1. A timepiece mainspring which is accommodated inside a barrel in a loaded state with an arbor end of the mainspring being fixed to a barrel arbor, and a wheel end of the mainspring engaging an inner wall of the barrel, the timepiece mainspring comprising:

a helical body;

a main body; and a connection link connect the main body and the helical body, wherein, when the mainspring is in a free state having no applied load, the helical body is wound in a Bernoulli curve shape from the arbor end, the main body is wound counterclockwise to the helical body from the wheel end, and the arbor end is positioned radially outward from the wheel end, and the number of rolls of the helical portion is 2.5 rolls or more.

2. A timepiece mainspring comprising:

an inner end that is accommodated inside a barrel, and that is fixed to a barrel arbor included in the barrel;

a winding portion that is continuous with the inner end, and that is wound around the barrel arbor;

a helical portion that is continuous with the winding portion; and an outer end that engages with an inner wall of the barrel, wherein in a free state having no applied load, the helical portion is wound in a Bernoulli curve shape, and the number of rolls of the helical portion is 2.5 rolls or more.

3. The timepiece mainspring according to claim 1, wherein a material of the timepiece mainspring is a nickel cobalt alloy.

4. The timepiece mainspring according to claim 2, wherein a material of the timepiece mainspring is a nickel cobalt alloy.

5. The timepiece mainspring according to claim 1, wherein a material of the timepiece mainspring is stainless steel.

6. The timepiece mainspring according to claim 2, wherein a material of the timepiece mainspring is stainless steel.

7. A timepiece drive device comprising:

the timepiece mainspring according to claim 1; and the barrel that accommodates the timepiece mainspring.

8. A timepiece drive device comprising:

the timepiece mainspring according to claim 2; and the barrel that accommodates the timepiece mainspring.

9. A timepiece movement comprising:

the timepiece drive device according to claim 7; and a gear that is driven by the timepiece drive device.

10. A timepiece movement comprising:

the timepiece drive device according to claim 8; and a gear that is driven by the timepiece drive device.

11. A timepiece comprising:

the timepiece movement according to claim 9.

12. A timepiece comprising:

the timepiece movement according to claim 10.

* * * * *